US006666265B1

(12) United States Patent
Kato et al.

(10) Patent No.: US 6,666,265 B1
(45) Date of Patent: Dec. 23, 2003

(54) HEAT EXCHANGER, METHOD OF MANUFACTURING THE HEAT EXCHANGER, AND METHOD OF MANUFACTURING TUBE FOR HEAT EXCHANGE

(75) Inventors: Soichi Kato, Saitama (JP); Muneo Sakurada, Saitama (JP); Shin Kurihara, Saitama (JP); Shoji Akiyama, Saitama (JP); Jun Akaike, Saitama (JP); Kazuo Ochiai, Saitama (JP)

(73) Assignee: Zexel Valeo Climate Control Corporation, Saitama (JP)

( * ) Notice: Subject to any disclaimer, the term of this patent is extended or adjusted under 35 U.S.C. 154(b) by 0 days.

(21) Appl. No.: 09/913,964

(22) PCT Filed: Oct. 2, 2000

(86) PCT No.: PCT/JP00/00764

§ 371 (c)(1),
(2), (4) Date: Aug. 21, 2001

(87) PCT Pub. No.: WO00/52410

PCT Pub. Date: Sep. 8, 2000

(30) Foreign Application Priority Data

Feb. 26, 1999 (JP) ..... 11-49578
Sep. 27, 1999 (WO) ..... PCT/JP99/05259

(51) Int. Cl.[7] ..... F28F 1/00
(52) U.S. Cl. ..... 165/177; 29/890.053
(58) Field of Search ..... 165/133, 177; 29/890.053

(56) References Cited

U.S. PATENT DOCUMENTS 4,546,824 A * 10/1985 Melnyk ..... 165/153
5,185,925 A * 2/1993 Ryan et al. ..... 29/890.049

FOREIGN PATENT DOCUMENTS

JP 4-86489 A * 3/1992 ..... F28F/1/02
JP 10-122778 A * 5/1998 ..... F28F/1/02

* cited by examiner

*Primary Examiner*—Allen Flanigan
(74) *Attorney, Agent, or Firm*—Kanesaka & Takeuchi

(57) ABSTRACT

A heat exchanger is comprising a core which is consisting of tubes provided with medium passages and fins fitted to the tubes, and tanks to which ends of the tubes are connected, wherein the tube (2) is formed to have a flat cross-sectional shape by joining ends of one or two plates, the ends of the plates have a contact portion which is formed by bending at least one of the plate ends a plurality of times and overlaying the one end on the other end, and the contact portion is provided with a joint portion (2c) which is formed by placing a part (2e) of the contact portion on the top or bottom flat surface and mutually engaging the both ends of the plate.

7 Claims, 13 Drawing Sheets

HEAT EXCHANGER, METHOD OF MANUFACTURING THE HEAT EXCHANGER, AND METHOD OF MANUFACTURING TUBE FOR HEAT EXCHANGE

TECHNICAL FIELD

The present invention relates to a heat exchanger to be used for a refrigerating cycle mounted on a vehicle or the like, a method of manufacturing the heat exchanger and a method of manufacturing a tube for heat exchange.

BACKGROUND ART

Conventionally, the heat exchangers to be used for the refrigerating cycle of vehicles and others are comprised of stacking a plurality of flat tubes, mounting fins between the stacked tubes, and connecting either end of the tubes to tanks. A heat exchange medium flowing from another apparatus of the refrigerating cycle into the tanks is distributed to the respective tubes to make heat exchange with outside air through the tubes and fins.

Generally, the tubes used for the heat exchangers are formed into a flat cross-sectional shape by joining the ends of one or two plates. Forming to have the flat cross-sectional shape is to enlarge a contact area between the fin and the tube so to efficiently conduct heat of the medium from the heat exchange tubes to the fins, thereby improving heat exchange performance.

For example, as shown in FIG. 11, a flat tube 2 is formed by bending a single plate at about its center to form a U-shaped cross section so to form beads or the like, and brazing to mutually adhere the opposed surfaces of both ends 2*h*, 2*h* of the plate.

The tubes 2 formed to have the flat cross-sectional shape are fitted with fins and alternately stacked to form a core, the both ends of the tubes 2 are fitted to tanks and brazed to form a heat exchanger 1.

But, the tube 2 having the opposed surfaces of the both ends 2*h*, 2*h* of the plate contacted with each other had a possibility that the portions, where the both ends 2*h*, 2*h* are joined, would open before or at brazing to degrade the assembling property of the tubes 2 and the tanks or to cause defective brazing.

And, when the tube 2 was formed by joining the both ends 2*h*, 2*h* of the plate, the joint portion had a shape protruded from the other portion of the tube, so that there was a possibility of causing defective brazing because tube insertion holes of the tanks into which the tubes were inserted became complex and a gap was formed between the tube fitted to the tube insertion hole and the tube insertion hole.

In addition, a heat exchange tube 40 described in Japanese Patent Application Laid-Open Publication No. Hei 10-274489 has fold-back portions 41, 41 which are formed by bending to fold back the ends of two plates which configure a tube, and which are mutually joined on the fold-back outer surfaces as shown in FIG. 12.

The heat exchange tube 50 described in Japanese Patent Application Laid-Open Publication No. Hei 11-248383 forms fold-back portions 51*a*, 51*b* at the ends of two plates, caulking the fold-back portions 51*a*, 51*b* after joining them mutually, and brazing the caulked portion as shown in FIG. 13.

But, the aforesaid tube 40 is formed to have a gap 42*a* in a triangle cross-sectional shape at the joint portion 42 where the fold-back portions 41, 41 are joined.

The tube 50 is also formed a gap 52*a* having a triangle cross-sectional shape in a joint portion 52 where the fold-back portions 51*a*, 51*a* are joined.

These gaps 42*a*, 52*a* having a triangle cross-sectional shape are not supplied with a sufficient amount of flux or a brazing material, resulting in the possibility of causing defective brazing.

When usual sizing is performed, the ends of the plates are rolled in a direction of the insides of the tubes 40, 50, and there is a disadvantage that the gaps 42*a*, 52*a* having a triangle cross-sectional shape are not filled with extra thickness of the plates.

And, a heat exchanger using the aforesaid tubes, such as a condenser, is generally mounted at the front or a lower part of a vehicle.

Therefore, a small stone or the like having entered from the outside into the vehicle tends to hit the front of the condenser and becomes a cause of breaking the tubes to leak a medium or the like, resulting in a problem that the air conditioner does not work.

Accordingly, it is an object of the present invention to improve an assembling property and a brazing property by preventing the joint portion of the tube from opening and modifying the peripheral shape of the tube, and to provide a heat exchanger using tubes resistant to stone hitting or the like, a method of manufacturing the heat exchanger and a method of manufacturing the tubes for the heat exchange.

SUMMARY OF THE INVENTION

The invention described in claim 1 is a heat exchanger comprising a core which is consisting of tubes provided with medium passages and fins fitted to the tubes, and tanks to which ends of the tubes are connected, wherein the tube is formed to have a flat cross-sectional shape by joining ends of one or two plates, the tube has a contact portion which is formed by bending at least one of the plate ends a plurality of times and overlaying the plate end on the other plate end, and a joint portion which is formed by placing a part of the contact portion on the top or bottom flat surface of the tube and mutually engaging the both ends of the plate.

For example, when a pressure is applied in directions of the top and bottom flat surfaces of the tube, an extra thickness at the end of each plate configuring the tube escapes in the direction of the mutually engaged contact portions, and the gaps in the contact portions are filled.

Therefore, the peripheries of the tube are restricted to within the tolerance of a predetermined dimension.

Thus, the tubes are improved in the assembling property with the tanks, and the gaps in the contact portions of the tubes are eliminated, so that adhesion between the tube insertion holes of the tanks and the peripheries of the tubes is improved, and the brazing property can be improved.

The invention described in claim 2 is the invention according to claim 1, wherein the tube is provided with a joint portion which is formed by fully covering the end of the tube with one of the plate ends and mutually engaging the both plate ends.

Here, the end of the tube means at least one of the ends of the tube.

For example, when sizing is performed to apply a pressure in the top and bottom flat surface directions of the tube, the extra thickness of the plate end produced by the application of pressure escape in a direction intersecting at right angles with the direction that the pressure is applied, so that the gap between the mutually engaged contact portions is filled with the extra thickness.

Therefore, the tube is restricted its periphery to within the tolerance of a predetermined size.

Thus, because the tube's assembling property with the tanks is improved and no gap is caused between the contact portions of the tubes, adhesion between the tube insertion holes of the tanks and the tube periphery is improved, and the tube can be improved its brazing property.

The invention described in claim 3 is a heat exchanger comprising a core which is consisting of tubes provided with medium passages and fins fitted to the tubes, and tanks to which ends of the tubes are connected, wherein the tube is provided with a joint portion which is formed by contacting at least one plate end surface to the other plate end, and the joint portion is such that one plate end surface is engaged with the other plate end brazed to prevent the tubes from opening.

When the tubes are prevented from opening, the assembling property of the tubes and the tanks becomes good. And, because the tubes are prevented from opening, the brazing property between the tubes and the tanks is improved, and it becomes possible to provide a quality heat exchanger free from a leakage of the medium or the like.

The invention described in claim 4 is the heat exchanger according to any of claims 1 to 3, wherein the joint portion of the tube uses a tube in which a portion positioned on at least the periphery of the tube is present in the same peripheral surface as the outer peripheral surface of the tube configuring the medium passages.

Thus, the joint portion of the tube has the portion positioned on at least the periphery of the tube present in the same peripheral surface as the outer peripheral surface of the tube configuring the medium passages, and the joint portion is not protruded.

Therefore, the tube insertion holes to be formed on the tanks can be made to have a simple shape, and the tube insertion holes can be formed with ease.

And, since the tube periphery and the tube insertion holes have a simple shape, no extra gap or the like is formed between the inserted tube and the tube insertion hole, and adhesion can be enhanced to improve the brazing property.

The invention described in claim 5 is the heat exchanger according to any of claims 1 to 4, wherein a vertical height of the joint portion is the same as that of the other portion excepting the joint portion of the tube having the medium passages.

Thus, when the height of the joint portion of the tube has the same size as the vertical height of the other portion excepting the joint portion of the tube, the joint portion does not protrude from the tube periphery, and the peripheral shape of the tube has a simple shape.

Therefore, the tube insertion hole in which the tube is inserted can be made to have a simple shape, and no extra gap is formed between the tube and the tube insertion hole, enabling to improve the assembling property and the brazing property of the tube and the tank.

The invention described in claim 6 is the heat exchanger according to any of claims 1 to 5, wherein the joint portion of the tube has at least one plate end surface within the joint portion.

Thus, the tube has at least the one plate end surface in the joint portion, so that the plate end surface can be engaged with the other plate end portion to prevent the tube from opening.

Therefore, the assembling property of the tube and the tank is improved, the brazing property between the tube and the tank is improved, and it becomes possible to provide a quality heat exchanger free from a leakage of the medium or the like.

The invention described in claim 7 is the heat exchanger according to any of claims 1 to 6, wherein the tube is provided with projections toward the medium passages.

Thus, when the projections are disposed in the medium passages of the tube, turbulence can be caused in the medium flowing through the medium passages, to improve the heat exchange efficiency.

The invention described in claim 8 is the heat exchanger according to any of claims 1 to 7, wherein the tube has the core which is comprised of the tubes and the fins brazed with the tanks.

Thus, the fins are mounted between the tubes or on the sides of the tubes to form the core in their multiple layer, the tubes are connected to the tube insertion holes of the tanks, and the tubes, fins and tanks are assembled.

And, the tubes, fins and tanks are integrally brazed in a furnace to form the heat exchanger.

The invention described in claim 9 is the heat exchanger according to any of claims 1 to 8, wherein the joint portion is disposed on one side surface of the core.

Thus, the heat exchanger of this example is formed with the joint portions of the tubes gathered to one side face of the core.

And, to mount on a vehicle body, the heat exchanger is mounted with the side face having the gathered joint portions directed toward the front of the vehicle body.

As described above, the joint portions are thicker than the other portion because at least one plate end is engaged with the other plate end portion and overlaid.

Therefore, by disposing the thick joint portion at the front of the vehicle body, an impact strength of the heat exchanger is improved, and a breakage due to stone hitting or the like can be prevented.

The invention described in claim 10 is the heat exchanger according to any of claims 1 to 9, wherein a cross-sectional profile of the joint portion has an arc with a diameter greater than the tube height on at least a part thereof.

The cross-sectional profile of the joint portion has an arc with a diameter larger than the vertical height of the tube, and the arc portion is made closer to a straight line.

Thus, when the profile of the joint portion of the tube is made to be closer to a straight line, a joint length of the fin and the tube is increased, so that the thermal conductivity is improved, and the heat radiation performance of the heat exchanger is improved.

The invention described in claim 11 is the heat exchanger according to any of claims 1 to 10, wherein the joint portion has a linear portion on a cross-sectional profile of the joint portion.

Thus, because the joint portion of the tube has the linear portion on the cross-sectional profile of the joint portion, a joint length of the fin and the tube is increased, the thermal conductivity is improved, and the heat radiation performance of the heat exchanger is improved.

The invention described in claim 12 is the heat exchanger according to any of claims 1 to 11, wherein the tube is formed to have a symmetrical shape in its breadthwise cross-sectional shape.

Thus, when the cross-sectional profile of the tube in its breadth direction is symmetrical, the tube insertion holes of the tank can be made to have a simple shape, formability of the tube insertion holes and the assembling property of the tubes and the tanks can be improved.

And, improper assembly that reversing the breadth direction of the tube symmetrically can be prevented.

The invention described in claim 13 is a method of manufacturing a heat exchanger comprising tubes having medium passages and performing heat exchange of a medium flowing through the medium passages, a core having the tubes and fins alternately stacked, and tanks to which the tube ends are mounted, the method comprising the steps of forming the tubes by bending a plate, sizing the formed tubes, and brazing the sized tubes.

Thus, the method of manufacturing the heat exchanger of the present invention has the step of sizing the formed tubes. After forming the tubes, deviations caused in the joint portions of the tubes are filled with the extra thickness produced by the pressure applied when sizing, and the periphery of the tube is limited to within the tolerance of a predetermined dimension.

Therefore, the assembling property and the brazing property of the tubes with other members are improved, and the quality heat exchanger can be provided.

The invention described in claim 14 is a method of manufacturing tubes for a heat exchanger comprising the steps of forming a bent portion which configures portion by bending at least one end of a plate, bending the plate into a flat shape, and engaging the formed end having the bent portion with the other end.

The plate has at least one end being bent to form the bent portion and bent at about the center of the plate into a U shape or another shape to form a tube having a flat cross-sectional shape, then the bent portions previously formed are mutually engaged to form the joint portion so to form the tube having a flat cross-sectional shape. Subsequently, the formed tubes are entirely sized to limit the tube peripheries to within the tolerance of a given dimension.

Thus, by limiting the tube peripheries to within the tolerance of the given dimension, the assembling property and brazing property of the tube insertion holes formed on the tanks and the tubes are improved, and a quality heat exchanger free from a leakage of the medium or the like can be provided.

BEST MODE FOR CARRYING OUT THE INVENTION

Embodiments of the invention will be described in detail based on the drawings.

Figure 1:
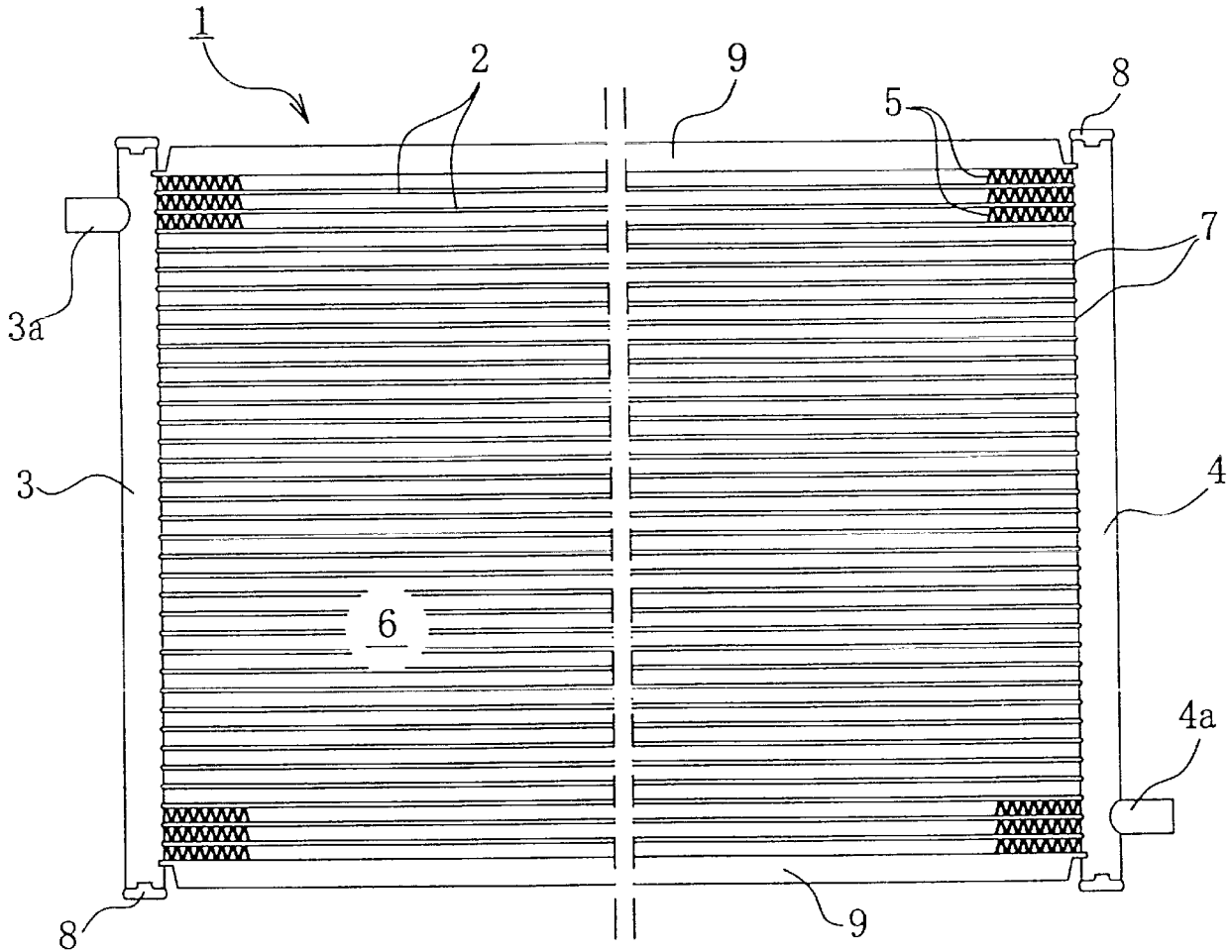
FIG. 1 is a front view of the heat exchanger according to an embodiment of the invention.

FIG. 1 is a front view showing a stack-type heat exchanger (condenser) 1 using flat tubes 2.

As shown in FIG. 1, the tubes 2 are provided with fins 5 and mutually stacked in parallel to configure a core 6. And, both ends of the tubes 2 are inserted into tube insertion holes 7 formed on two upright tanks 3, 4 so to be connected to communicate.

Top and bottom openings of the respective tanks 3, 4 are closed by caps 8, an inlet joint 3*a* for flowing in a heat exchange medium from the outside and an outlet joint 4*a* for flowing out the medium are disposed at predetermined points of the tanks 3, 4.

Side plates 9 are disposed on the top and bottom of the core 6 to protect the fins 5 disposed on the top and bottom sides of the tubes and to reinforce the core 6 by the side plates 9.

The heat exchange medium flows into the tank 3 through the inlet joint 3*a* and is distributed into the respective tubes 2. The medium distributed into the tubes 2 meanders a plurality of times in a group unit of a predetermined number of tubes to flow between the tanks 3, 4 while performing the heat exchange with the outside air through the tubes 2 and the fins 3, and discharged through the outlet joint 4*a* of the tank 4 so to be circulated in the refrigerating cycle.

FIG. 1 shows a condenser for condensing a high-temperature, high-pressure medium to a low temperature, but it is also possible to use the tube of this embodiment to be described afterward for an evaporator or the like for heat exchanging the medium which was expanded and became a low temperature by an expansion valve.

Then, the tube to be used for the aforesaid condenser, an evaporator or the like will be described.

Figure 2:
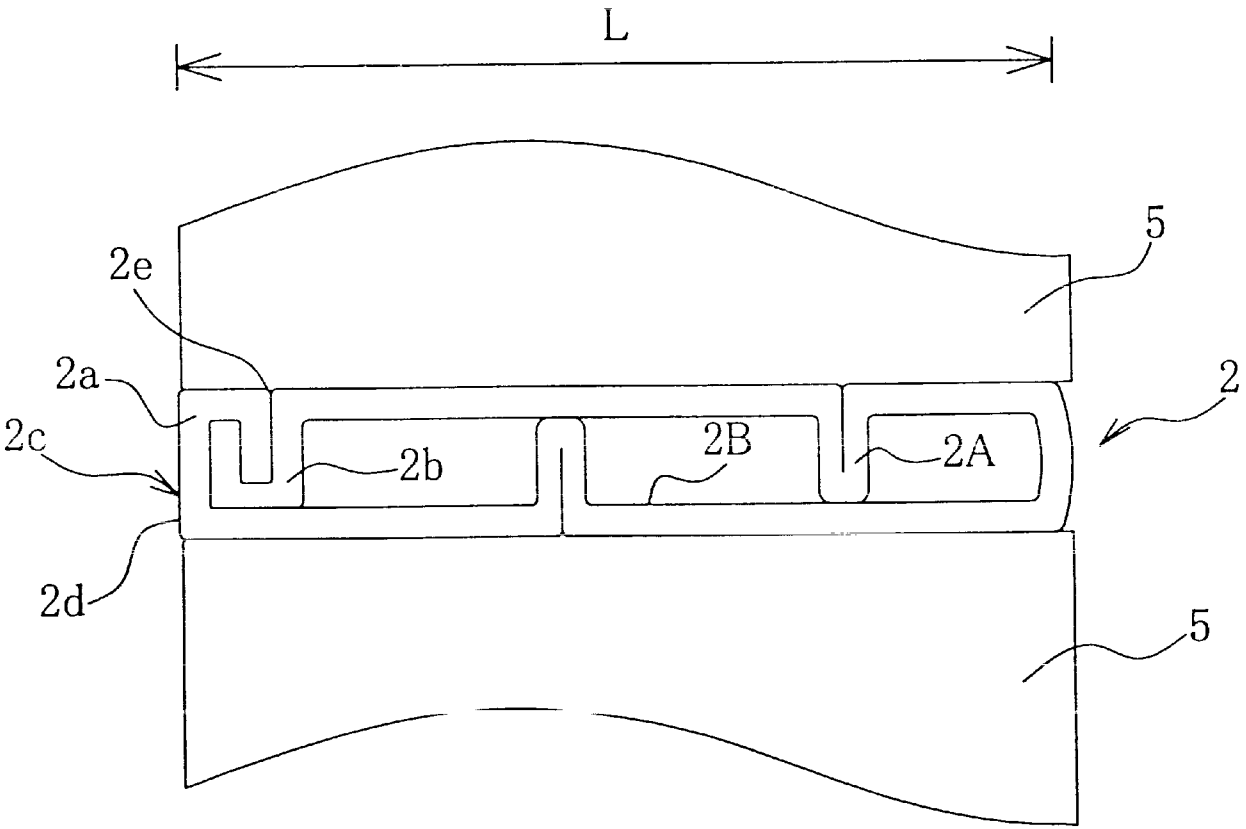
FIG. 2 is a diagram showing an end surface of a heat-exchanging flat tube and fins in part according to a first embodiment of the invention.

FIG. 2 is a diagram showing the end surface of the tube 2 to be used for the aforesaid heat exchanger 1. The tube 2 is formed of a single plate made of aluminum or an aluminum alloy by roll forming or the like.

As shown in FIG. 2, the tube 2 is formed a bent portion 2*a* by bending one end of the plate at substantially right angles in a direction of the internal periphery of the tube, bending its leading end at substantially right angles in a direction of the end, and then bending again at substantially right angles so to be parallel to the bent portion which was bent first.

And, the other end of the plate is bent at substantially right angles in a direction to an opposed surface against the tube, bent at substantially right angles in a direction of the internal periphery of the tube, and finally bent to form a bent portion 2*b* by bending again at substantially right angles so to be parallel with the bent portion which was bent first.

Then, the plate is bent at the center to have a U shape, so that projections 2A or the like are formed, and the plate is formed to have a flat cross-sectional shape.

And, the bent portions 2*a*, 2*b* are mutually engaged to provide a joint portion 2*c*, thereby forming the tube 2.

The projections 2A are protruded toward the surfaces opposite to the top and bottom flat surfaces to contact the tops of the projections 2A with the flat surfaces of the tube 2 so to divide a medium passage 2B of the tube 2 into a plurality of sections.

Thus, disposing the projections 2A within the medium passage of the tube causes turbulence in the flow of the medium flowing through the medium passage, thereby improving a heat exchange efficiency.

And, the joint portion 2*c* has the both end surfaces of the plate contacted with the recessed section of the bent portion 2*a* and the recessed section of the bent portion 2*b* and has a part (contact portion 2*e*) of the contact portion, where the bent portions 2*a*, 2*b* are mutually contacted, positioned on the top surface of the tube 2.

And, the bent portions 2*a*, 2*b* are inserted their leading ends into the recessed sections, and the contact portion 2*e* is caught by the other bent portion 2*b*.

Therefore, the both end surfaces of the plate are formed to be located within the joint portion 2*c*, so that the formed tube 2 is prevented from opening.

And, the entire end side of the tube 2 forms the joint portion 2*c* by covering the bent portion 2*b* with the other bent portion 2*a*, and the joint portion 2*c* has a linear portion 2*d* on its cross-sectional profile.

The tube 2 is then sized before completing the formation of the tube 2.

When the sizing is performed, a pressure is applied in directions of the top and bottom flat surfaces of the tube, extra thickness of the plate produced by the applied pressure escapes toward the mutually engaged contact portion 2*e* to fill the gap in the contact portion 2*e* with the extra thickness. Therefore, the tube 2 has its periphery limited to within the tolerance of a predetermined dimension.

Thus, the tube 2 is improved its assembling property with the tanks, adhesion between the tube insertion holes of the tanks and the periphery of the tube 2 is improved because there is no gap between the contact portion 2*e* of the tube 2, and a brazing property is improved.

Besides, a vertical height of the joint portion 2*c* where the bent portions 2*a*, 2*b* having the ends of the plate bent are mutually engaged is the same as that of the other portion of the tube 2, and the joint portion 2*c* is on the same plane as the peripheral surface of the other portion of the tube 2.

In other words, the tube 2 has a simple shape without protruding as compared with the other portion or having an irregular shape on the cross-sectional profile of the tube 2 because the joint portion 2*c* is provided.

Therefore, a shape of the tube insertion hole 7 of the tank which is formed to suit the peripheral shape of the tube 2 becomes simple, and the tube insertion hole 7 is formed with ease.

And, the joint portion 2*c* has the linear portion 2*d* on its cross-sectional profile, so that a contact length L of the fin 5 and the tube 2 is increased more than a case of having a curvature on the cross-sectional profile of the joint portion 2*c*.

Therefore, the tube 2 improves a thermal conductivity to the fin 5 and heat radiation performance of the heat exchanger.

And, the joint portion 2*c* has a greater thickness than the other portion of the tube 2 because the bent portions 2*a*, 2*b* are mutually engaged and brazed.

The heat exchanger 1 has the tubes 2, the fins 5, the tanks 3, 4, etc. assembled with the joint portions 2*c* gathered to one side of the core 6.

The heat exchanger 1 having all members assembled is formed by assembling the tubes 2, the fins 5 and the tanks 3, 4, and integrally brazing them in a furnace with a brazing material clad to the respective members or a brazing material separately supplied into the gaps of the respective members.

For example, where the brazing material is clad to the surface forming the inner medium passage of the tube 2, the brazing material clad to the fins 5 melts into the joint portion of the tubes 2 and the fins 5 to braze the tubes 2 and the fins 5 with the brazing material supplied from the fins 5.

And, when the heat exchanger 1 is to be mounted on a vehicle body, it is so disposed that the side face of the core 6 having the joint portions 2*c* gathered is located in the front side of the vehicle, so that an impact strength of the core 6 is improved by the thick joint portions 2*c*.

Therefore, the heat exchanger 1 is improved its durability and safety against stone hitting or the like.

Then, a second embodiment of the invention will be described.

A single plate 10 for configuring a tube 20 is formed a first bent portion 11 and a second bent portion 12 by bending both ends of the plate 10 in an opposite direction by 180 degrees. Each bent portion is thus formed to have a plurality of bent sections, as shown in FIG. 3(4), which lie against each other in folded relationship at the plate edge.

Figure 3:
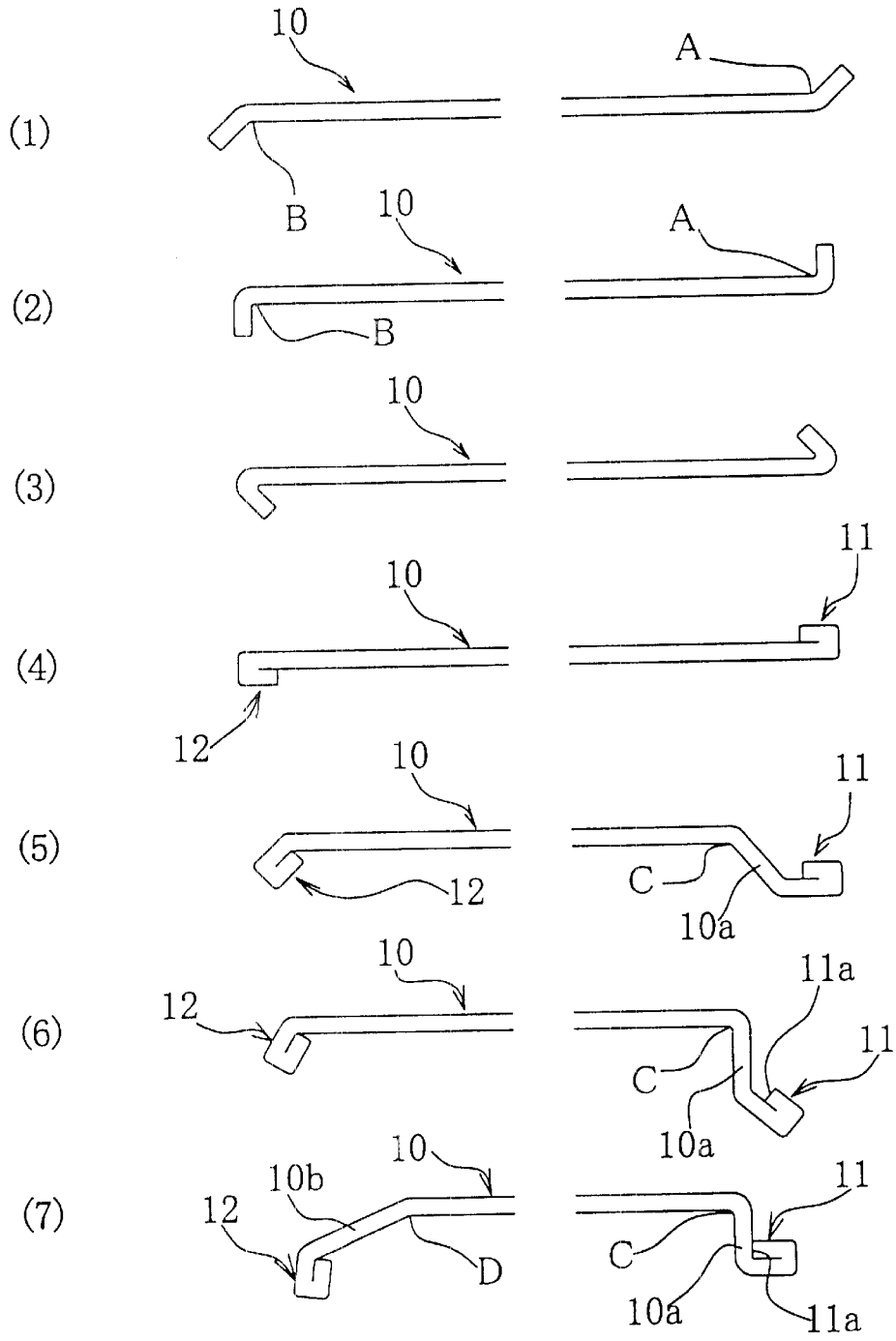
FIG. 3 is a process diagram showing steps of manufacturing a flat tube for the heat exchanger according to a second embodiment of the invention.

Specifically, first bent section of the first and second bent portions 11, 12 are gradually bent to have external angles of 90 and 120 degrees at bending fulcrums A and B which are apart by a predetermined distance from the ends of the plate 10 to finally bend them in the opposite direction so that they lie against respective second bent sections in order to form the first and second bent portions 11, 12 as shown in FIG. 3(1) to FIG. 3(4).

Then, an end surface 11*a* of the plate 10 configuring the first bent portion 11 is contacted to one surface of the plate 10 as shown in FIG. 3(5) to FIG. 3(7). And, a bight 10*a* is formed by bending at a fulcrum C of the plate to vertically protrude the first bent portion 11.

On the other hand, the second bent portion 12 is gradually bent to have an angle at a fulcrum D of the plate so to form a bight 10*b*.

In other words, the first and second bet portions 11, 12 are formed to protrude from the plate 10.

Figure 4:
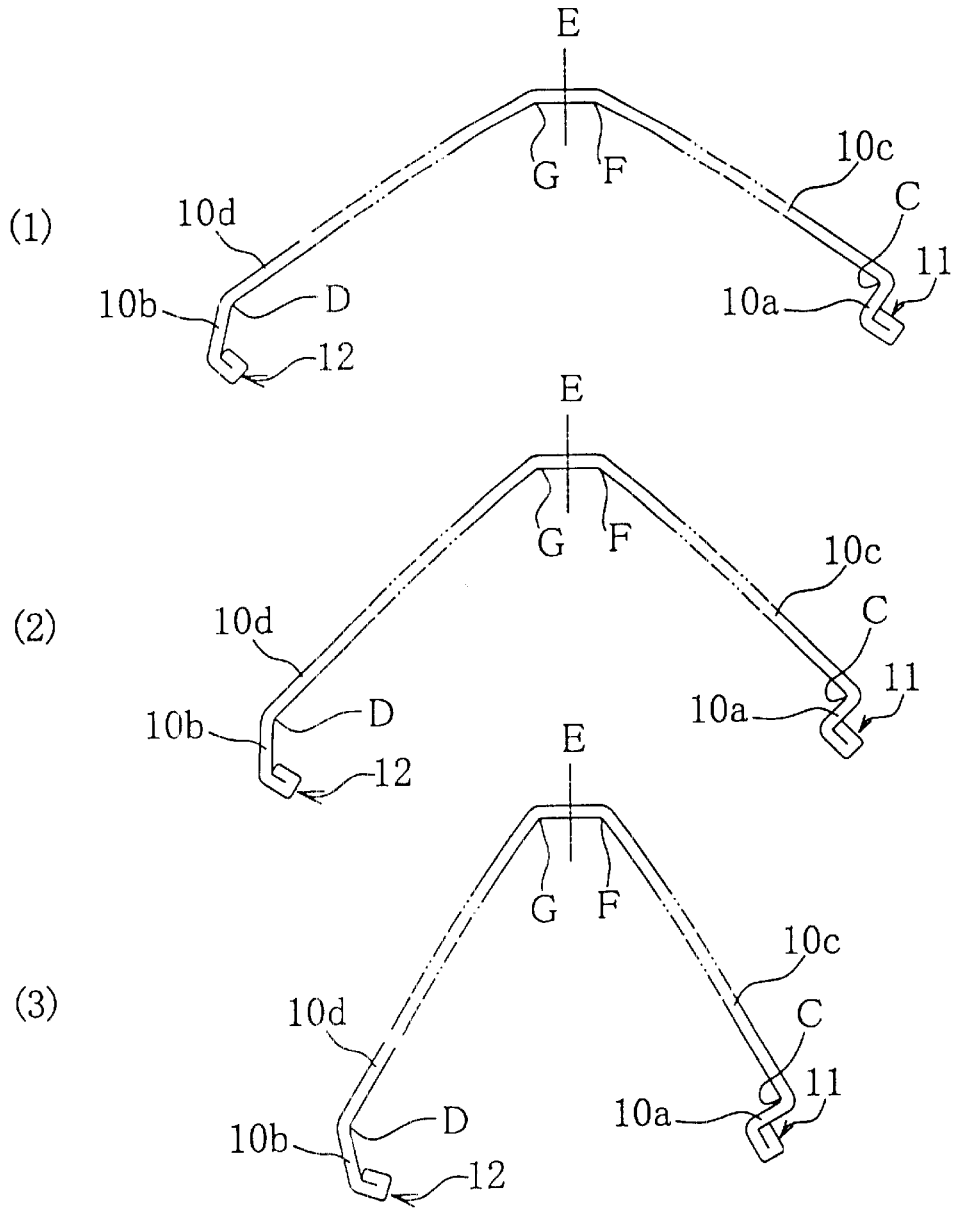
FIG. 4 is a process diagram showing subsequent steps of the manufacturing process shown in FIG. 3.

Then, two folding fulcrums F, G are determined at a distance equal to a width in a vertical direction of the tube from a center line E of the plate 10, and the plate is bent at the fulcrums F, G so that first and second flat surfaces 10*c*, 10*d* become parallel to each other as shown in FIG. 4 (1) to (3).

Figure 5:
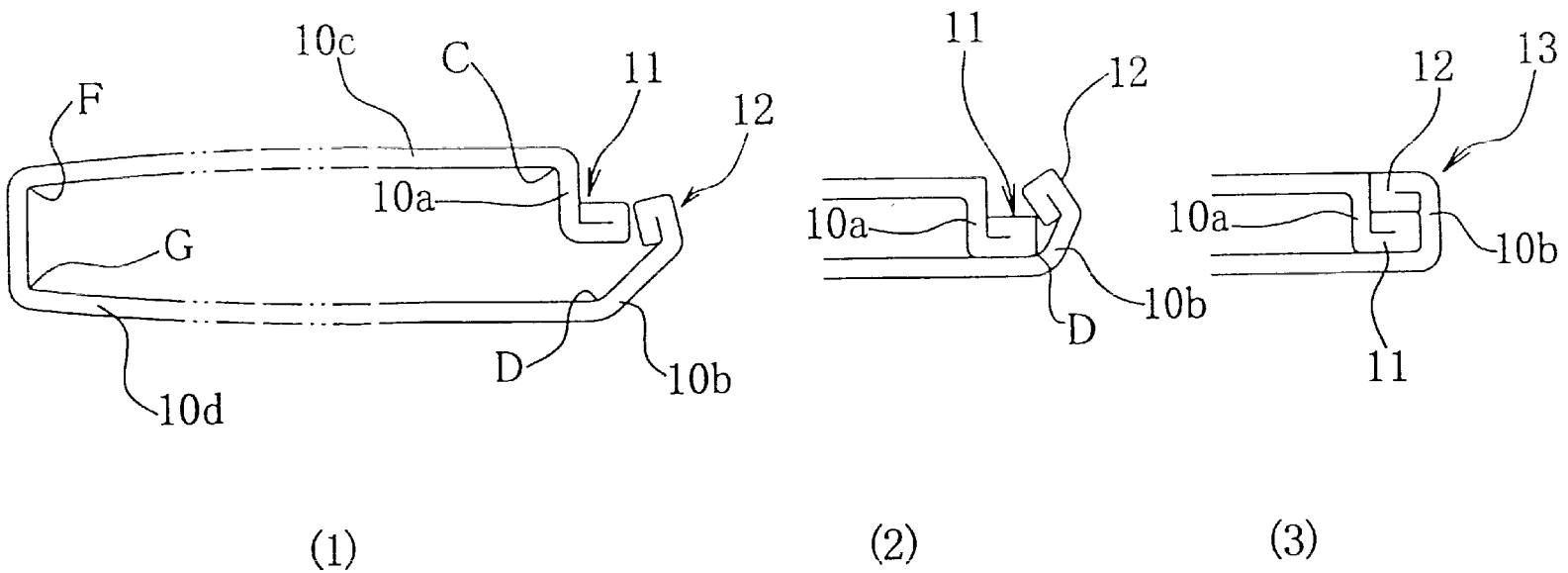
FIG. 5 is a process diagram showing steps of forming a tube by engaging the tube ends formed by the steps shown in FIG. 3 and FIG. 4.

As shown in FIG. 5, the tube 20 has a height between the fulcrums F and G, and the first and second flat surfaces 10*c*, 10*d* respectively form the plate of the tube.

And, the first and second bent portions 11, 12 are engaged as a joint portion 13 to form the tube 20 having a flat cross-sectional shape.

Specifically, the second bight 10*b* is bent at the fulcrum D to cover the first bent portion 11 from its periphery to contact the top of the second bent portion 12 to the first bight 10*a* as shown in FIG. 5 (1) to (3).

Figure 6:
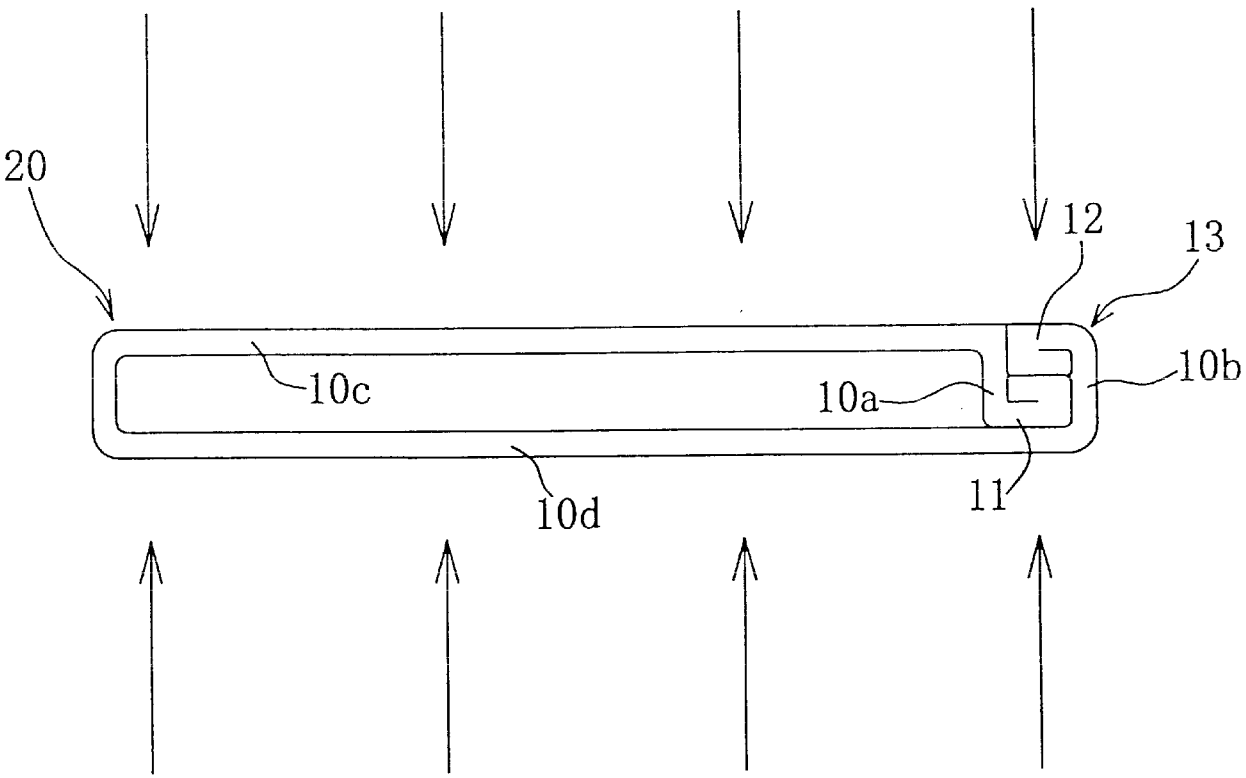
FIG. 6 is a diagram showing the end surface of the tube formed by the steps shown in FIG. 3 to FIG. 5.

As shown in FIG. 6, the joint portion 13 has a state that the plate is folded in five.

Thus, the joint portion 13 can prevent the formed tube 20 from opening because the first and second bent portions 11, 12 are mutually engaged to have a mutually caught state.

The tube 20 is completed its forming by sizing after forming the joint portion 13.

Generally, the sizing is performed by disposing rollers to have the tube 20 therebetween, and applying a pressure to the top and bottom flat surfaces 10*c*, 10*d* of the tube 20 so to decrease the plate thickness of the joint portion 13 by 2% to 7%.

Arrows in FIG. 6 indicate directions that the pressure is applied to the tube 20 when sizing.

A portion of the contact portion between the first bent portion 11 and the second bent portion 12 is positioned on the top flat surfaces 10*c*.

When the sizing is applied to the tube 20, the pressure is applied from the directions of top and bottom flat surfaces 10*c*, 10*d*, and extra thickness of the plate escapes in a direction to intersect at right angles with the pressure applying direction, namely into the contact portion between the first bent portion 11 and the second bent portion 12.

Therefore, the tube 20 has the gap in the joint portion 13 properly filled by the extra thickness of the plate produced by sizing, and the periphery of the tube 20 is restricted to within the tolerance of a predetermined dimension.

Thus, the tube 20 is improved its assembling property and brazing property with the tank.

And, the joint portion 13 has a greater thickness than the other portion of the tube 20 because it has a state that five plates are stacked.

Accordingly, where the heat exchanger is mounted on a vehicle body with the side section of the core having the joint portion 13 at the front, its impact strength against the stone hitting or the like is improved. Therefore, the heat exchanger excelling in the durability and safety can be provided.

Figure 7:
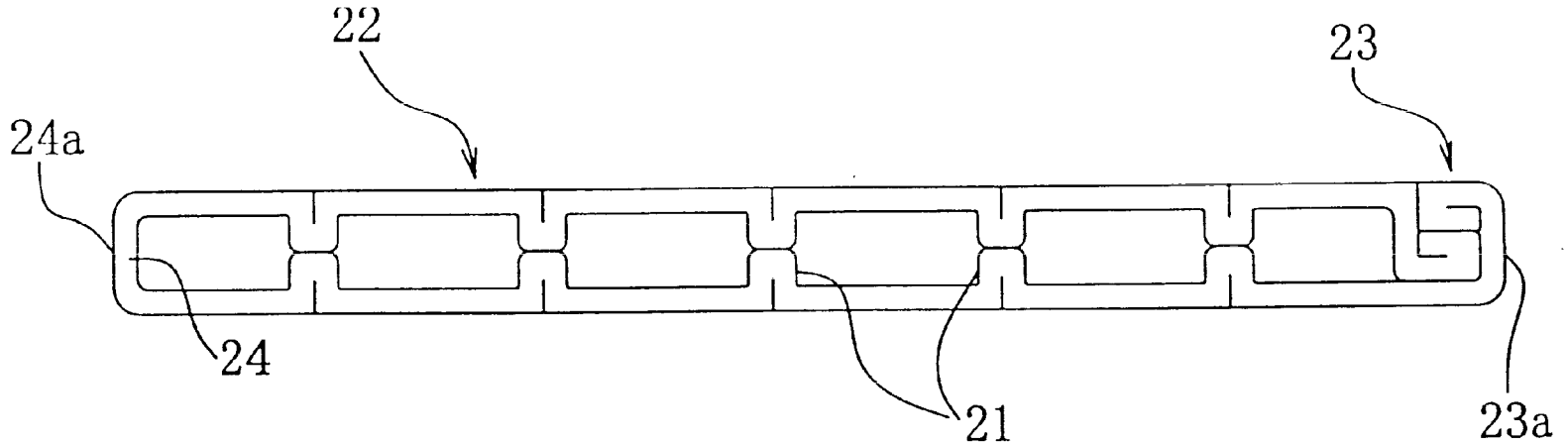
FIG. 7 is a diagram showing the end surface of the tube provided with projections formed on the tube shown in FIG. 6.

For example, as shown in FIG. 7, a tube 22 having projections 21 on the top and bottom flat surfaces also has the same effect as the aforesaid tube 20.

And, the tube 22 has a symmetric cross-sectional shape. Therefore, the tube insertion hole shape can also be formed to have a symmetric shape, so that orientation is not required when assembling the tubes, improper assembly of the tubes 22 can be prevented, and workability is improved.

And, a joint portion 23 and a bending portion 24 have linear portions 23*a*, 24*a* at both ends of the tube 22.

Thus, when the tube 22 is formed to have the linear portions 23*a*, 24*a* on its both ends in cross section, a joint length of the fin and the tube 22 is increased, thermal conductivity from the tube 22 to the fin is improved, and heat radiation performance of the heat exchanger is improved.

Figure 8:
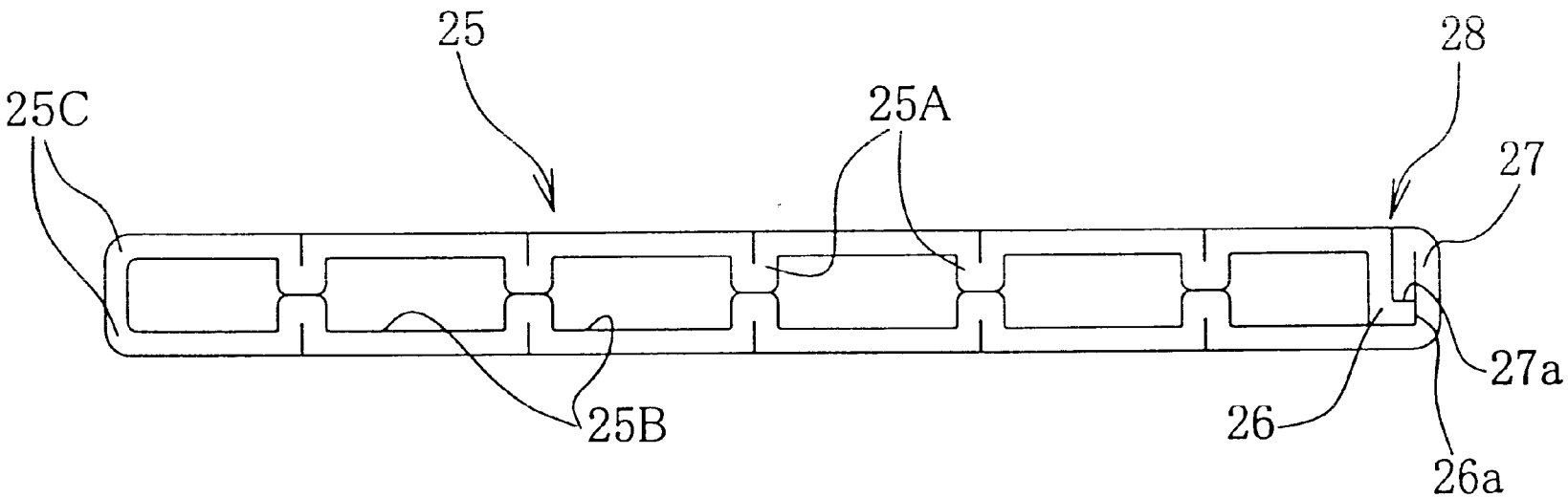
FIG. 8 is a diagram showing the joint portion of the tube according to a third embodiment of the invention.

FIG. 8 is a diagram showing an end surface of the tube of a third embodiment of the invention.

First, a tube 25 is formed a first bent portion 26 by bending one end of a plate at substantially right angles in a direction of the opposite flat surface, and bending its leading end again at substantially right angles in a direction of the periphery of the tube so to come into contact with the opposed flat surface.

Then, the other end of the plate is bent at substantially right angles in a direction of the opposed flat surface, and its leading end is bent at about 180 degrees to form a second bent portion 27.

Besides, projections 25A are formed at predetermined positions of the plate, the tops of the projections 25A formed on the flat surfaces of the tube 25 are mutually contacted, bent portions 25C are formed by bending the plate at two points which are apart from each other by a predetermined distance from about the middle of the plate, and the first and second bent portions 26, 27 are mutually engaged to form a joint portion 28, thereby forming the tube 25 having a flat cross-sectional shape.

Medium passages 25B in the tube 25 are divided into a plurality of sections by the projections 25A.

The tube 25 has its end entirely covered with the second bent portion 27, so that both end surfaces 26*a*, 26*a* of the plate are positioned within the joint portion 28.

And, the first and second bent portions 26, 27 are mutually engaged, so that the joint portion 28 is prevented from opening.

The tube 25 is sized by applying a pressure in the top and bottom flat surface directions before completing the forming.

By the pressure applied at sizing, the tube 25 is caused to have extra thickness of the plate, the extra thickness of the plate escapes in a direction of the contact portion of the first and second bent portions 26, 27 to properly fill the gap in the contact portion by the extra thickness.

Therefore, the tube 25 is restricted its peripheral shape to a predetermined dimension.

And, a cross-sectional shape of the tube 25 has a symmetrical shape, so that improper assembly when assembling to the tube insertion holes can be prevented.

And, the bent portions 25C and the joint portion 28 which are symmetrical are formed to make a part of the cross-sectional profile to be a linear section, so that a contact length of the fin and the tube is increased, the thermal conductivity from the tube to the fin is improved, and the heat radiation performance of the heat exchanger is improved.

Then, a fourth embodiment of the invention will be described.

Figure 9:
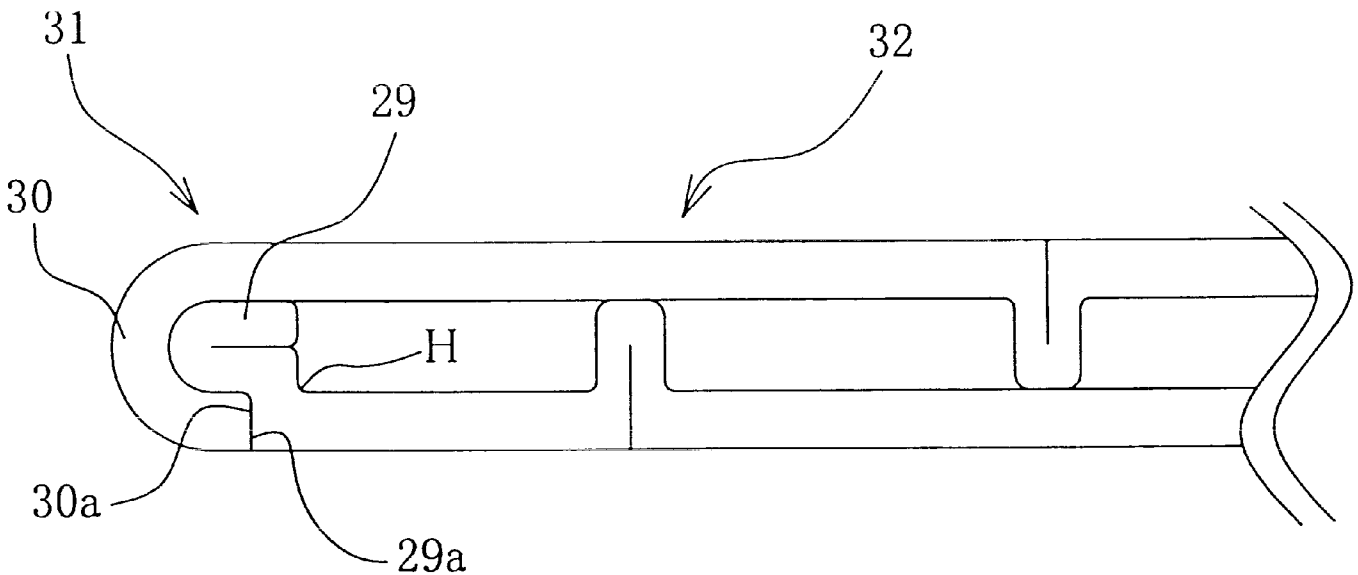
FIG. 9 is a diagram showing a part of the end surface of the tube according to a fourth embodiment of the invention.

FIG. 9 is a diagram showing a part of an end surface of the tube of the fourth embodiment.

A tube 32 of this embodiment has a first bent portion 29 which is formed by bending one end of a plate configuring the tube 32 by 180 degrees so to fold it.

The bent portion 29 is made to have a bending fulcrum H at a predetermined position remote from the bent portion 29, and bent by about 90 degrees at the fulcrum H to form a shoulder portion 29*a* between the folded portion.

Then, the tube 32 is provided with a second bent portion 30 which is formed by bending the other end of the plate to cover the bent portion 29 from its periphery to connect the first and second bent portions 29, 30, and one end surface 30*a* of the plate is engaged with the shoulder 29*a* to form a joint portion 31 to prevent it from opening.

Therefore, the formed tube 32 can produce a good heat exchanger because the joint portion 31 is brazed without causing a leakage of the medium or the like due to opening of the joint portion 31.

And, the tube 32 has the gap between the bent portions 29, 30 filled by the extra thickness of the plate by sizing, and a periphery shape of the tube 32 is restricted to within the tolerance of a predetermined dimension.

As shown in FIG. 9, the cross-sectional profile of the joint portion of this embodiment is a projection mass. Here, the projection mass is a mass which includes all segments connecting any two points. Specifically, where the cross-sectional profile of the joint portion configures the projection mass, the periphery of the tube 32 can be made simple because only the joint portion 31 does not become a shape protruded from a portion other than the joint portion 31 of the tube 32.

Therefore, the tube insertion hole to be mated with the peripheral shape of the tube can be formed with ease, and workability is improved.

And, the assembling property of the tube 32 with the tank is improved and the brazing property is improved because an excess gap or the like is not caused between the tube insertion hole and the tube periphery.

Then, a fifth embodiment of the invention will be described.

Figure 10:
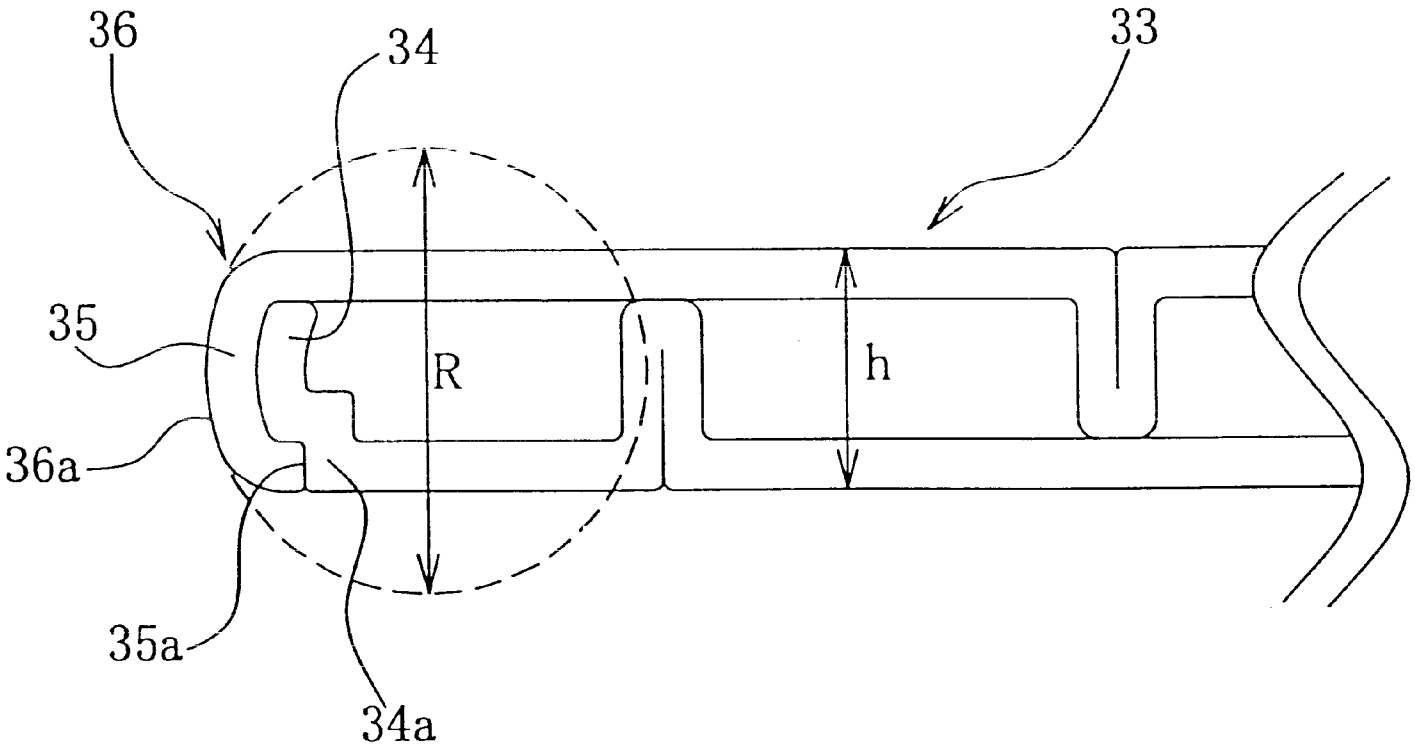
FIG. 10 is a diagram showing a part of the end surface of the tube according to a fifth embodiment of the invention.
Figure 11:
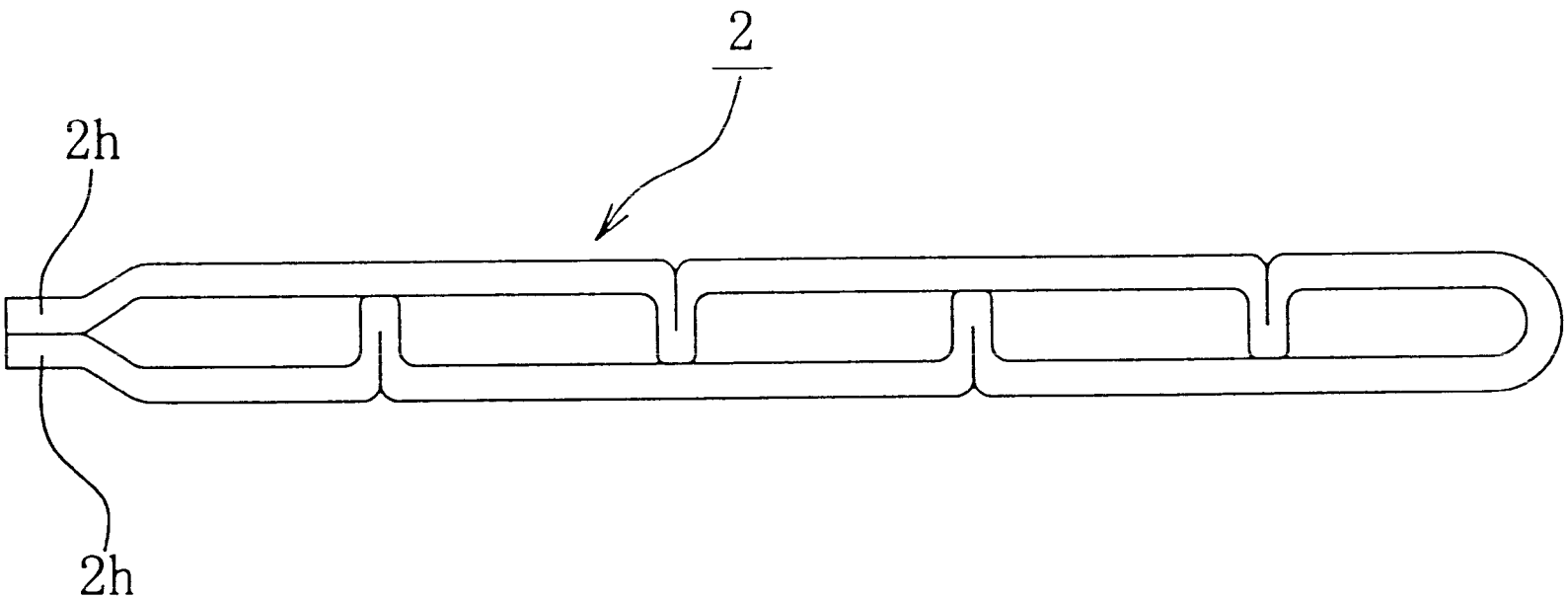
FIG. 11 is a diagram showing the end surface of the tube according to a prior art.
Figure 12:
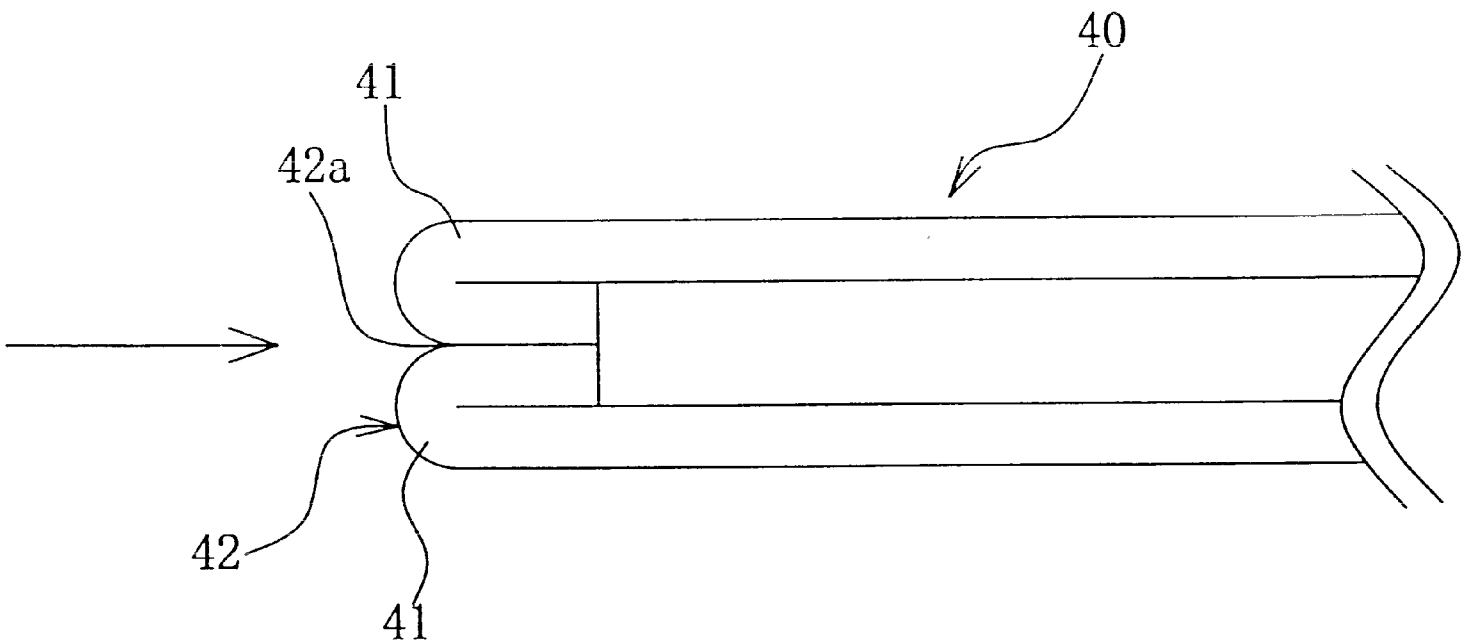
FIG. 12 is a diagram showing a part of the end surface of the tube according to a prior art.
Figure 13:
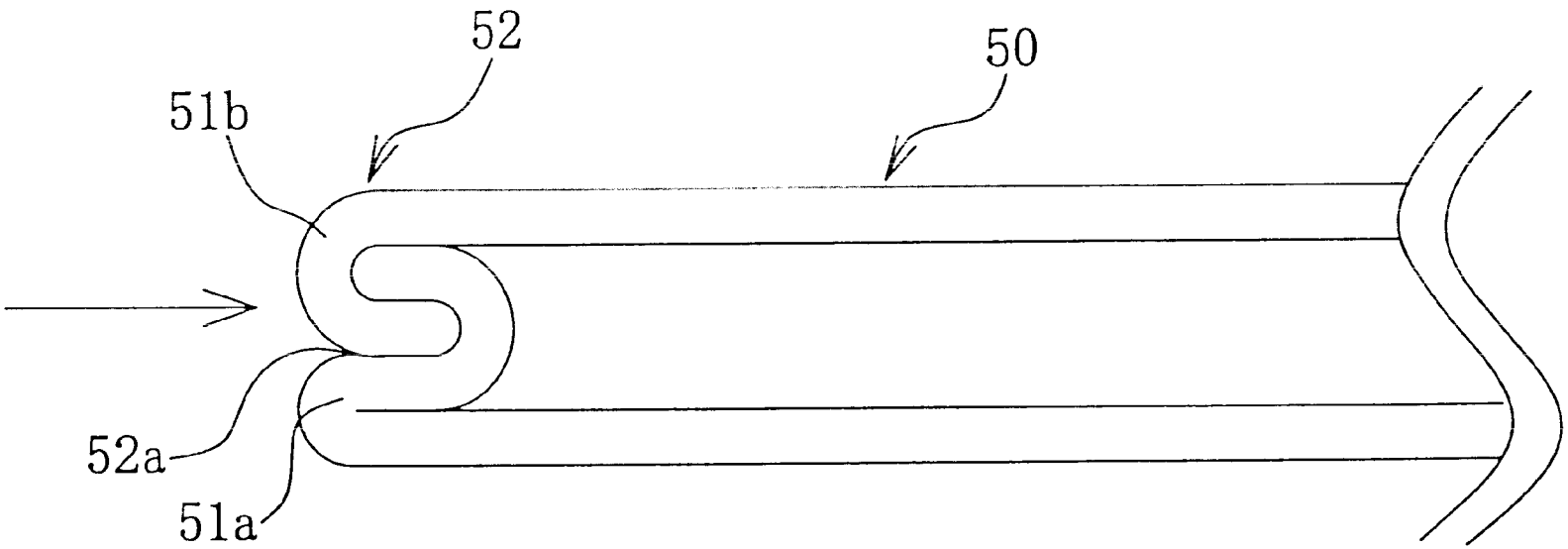
FIG. 13 is a diagram showing a part of the end surface of the tube according to a prior art.

As shown in FIG. 10, a tube 33 is formed a first bent portion 34 which has a shoulder 34*a* corresponding to a thickness of the plate by contacting one end face of the plate to the opposed flat surface of the tube 33.

And, the tube 33 has a second bent portion 35 formed by overlaying the other end of the plate onto the first bent portion 34 by covering it from its periphery, and a joint portion 36, which is prevented from opening, formed by engaging an end surface 35*a* of the plate with the shoulder 34*a*.

The joint portion 36 has a cross-sectional profile which has an arc part 36*a* with a diameter R larger than a vertical height h of the tube 33.

When the cross-sectional profile of the joint portion 36 of the tube 33 has the arc part 36*a* with the diameter R larger than the vertical height h of the tube 33, the cross-sectional profile of the joint portion 36 becomes close to a linear shape.

In other words, it is $h<R$, and the arc part 36 becomes closer to a straight line as R becomes larger.

Thus, where the periphery of the profile of the joint portion 36 of the tube 33 is made to have a shape close to a straight line, a joint length of the fin and the tube 33 is increased, so that the thermal conductivity is improved and heat radiation performance of the heat exchanger is improved.

And, the tube 33 is formed with the gap in the contact portion of the first and second bent portions 34, 35 with extra thickness of the plate filled by sizing and a periphery shape of the tube 33 restricted to within the tolerance of a predetermined dimension.

The formed tube 33 is brazed while being prevented from opening, so that a good heat exchanger can be produced without causing a leakage of the medium or the like.

INDUSTRIAL APPLICABILITY

The present invention is a heat exchanger to be applied to automobiles and household electrical appliances and a method of manufacturing tubes used for the heat exchanger, and enables to provide a good product which does not cause a leakage of the medium or the like while preventing a joint portion of the tubes from opening and improving a brazing property.

What is claimed is:

1. A heat exchanger comprising:

a plurality of tubes of a flat sectional shape, each tube made of one or two plates and having a plurality of medium passages therein and a joint portion along a side edge of said tube;

a plurality of fins provided between said tubes; and a pair of tanks with which said ends of said tubes are brazed, said joint portion being made by locking a first bent portion and a second bent portion of said tube such that no gap is produced at contact portions, each of said first and second bent portions has a plurality of bent sections at end portions of said plate or an end portion of each of said two plates, wherein said plurality of bent sections of said first bent portion do not interlock with said plurality of bent sections of said second bent portion when said joint portion is formed.

2. The heat exchanger according to claim 1, wherein an outer side surface of said joint portions is formed only by said first bent portion.

3. The heat exchanger according to claim 2, wherein said joint portion has a linear portion in said outer surface.

4. The heat exchanger according to one of claims 1–3, wherein a height of said joint portion is the same as that of the other portions of said tube.

5. The heat exchanger according to one of claims 1–3, wherein a thickness of said joint portion is greater than that of said other portions of said tube.

6. The heat exchanger according to one of claims 1–3, wherein said tube has a symmetric cross-sectional shape in a vertical direction.

7. The heat exchanger according to one of claims 1–3, wherein said joint portion holds distal ends of said first and second bent portions therewithin.

* * * * *